US007363771B2

(12) United States Patent
Choi et al.

(10) Patent No.: US 7,363,771 B2
(45) Date of Patent: Apr. 29, 2008

(54) AIR CONDITIONER

(75) Inventors: Dae-Hwan Choi, Busan (KR); Kyungsoo Lee, Busan (KR); Yoon-Seob Eom, Changwon (KR); Jeong-Hwan Koo, Busan (KR); Jun-Sang Ryu, Goyang (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 10/539,554

(22) PCT Filed: Dec. 18, 2002

(86) PCT No.: PCT/KR02/02385

§ 371 (c)(1),
(2), (4) Date: Jun. 16, 2005

(87) PCT Pub. No.: WO2004/055442

PCT Pub. Date: Jul. 1, 2004

(65) Prior Publication Data

US 2006/0248909 A1 Nov. 9, 2006

(51) Int. Cl.
*F25B 47/00* (2006.01)

(52) U.S. Cl. ..... 62/280; 62/262

(58) Field of Classification Search ..... 62/262, 62/280, 305, 279
See application file for complete search history.

(56) References Cited

U.S. PATENT DOCUMENTS

| | | | | |
|---|---|---|---|---|
| 2,776,554 A | | 1/1957 | Pigman | |
| 3,152,456 A | * | 10/1964 | Prendergast | 62/262 |
| 4,136,529 A | * | 1/1979 | McCarty | 62/280 |
| 4,382,369 A | | 5/1983 | Stocking | |
| 5,392,613 A | | 2/1995 | Bolton | |

* cited by examiner

*Primary Examiner*—Melvin Jones
(74) *Attorney, Agent, or Firm*—Birch, Stewart, Kolasch & Birch, LLP

(57) ABSTRACT

In an air conditioner, the air conditioner includes a casing having an indoor space region and an outdoor space region; an indoor unit installed in the indoor space region, sucking air and cooling the sucked air through a first heat exchanger, an outdoor unit installed in the outdoor space region, sucking air and releasing heat of the air to the outside through a second heat exchanger; and a turbo fan installed in the outdoor space region for generating air flows so as to flow air to the second heat exchanger.

8 Claims, 4 Drawing Sheets

AIR CONDITIONER

TECHNICAL FIELD

The present invention relates to an air conditioner.

BACKGROUND ART

An air conditioner is for adjusting temperature, humidity, air current in a certain space so as to be appropriate for activity of human being and removing dust, etc. from air simultaneously.

The air conditioner consists of an indoor unit for cooling/heating indoor air and an outdoor unit for discharging/absorbing heat generated in the indoor unit to outdoors, the indoor unit and the outdoor unit can be installed separately or as one body.

In particular, an air conditioner having an indoor unit and an outdoor unit as one body is called a single unit type air conditioner or a window type air conditioner (hereinafter, it is referred to an single unit type air conditioner).

FIG. 1 is a longitudinal-sectional view illustrating the conventional single unit type air conditioner.

As depicted in FIG. 1, the conventional single unit type air conditioner includes a casing 10 having an indoor space region 21 and an outdoor space region 31 separately formed by a separation plate 11; a compressor 12 installed in the indoor space region 21 and compressing refrigerant into high temperature and high pressure state; an outdoor unit 30 being installed in the outdoor space region 31 and having a condenser 32 for cooling the refrigerant compressed by the compressor 12; and an indoor unit 20 installed in the indoor space region 21 and having an evaporator 22 performing heat exchange between the refrigerant condensed in the condenser 32 and indoor air.

A motor 13 is installed at the center of the separation plate 11, a fan 23 for generating an air flow is installed at a rotational shaft 13*a* of the motor 13 in the indoor space region 21 in order to make sucked indoor air pass the evaporator 22, and a cooling fan 33 for generating an air flow is installed at the rotational shaft 13*a* of the motor 13 in the outdoor space region 31 in order to make sucked outdoor air pass the condenser 32.

In general, a turbo fan is used as the fan 23, and an axial fan is used as the cooling fan 33.

In the conventional single unit type air conditioner, when power is applied, the compressor 12 compresses the refrigerant in the operation, the refrigerant compressed in the compressor 12 releases heat to the outdoor air sucked by the cooling fan 33 while passing the condenser 32, and accordingly the refrigerant is cooled.

The refrigerant cooled while passing the condenser 32 flows to the evaporator 22, performs heat exchange with the indoor air sucked by the fan 23 and cools the indoor air so as to be at a certain temperature.

Herein, condensate water is generated on the surface of the evaporator 22 while the indoor air is cooled.

The air conditioner includes a condensate water discharge unit (not shown) for discharging condensate water generated in the operation to the outside, and a flow channel (not shown) is formed at a bottom region 14 of the casing 10 in order to make the condensate water flow from the indoor space region 21 to the outdoor space region 31 smoothly.

In more detail, the condensate water condensed on the surface of the evaporator 22 flows to the bottom region 14 of the casing 10 and flows to the outdoor space region 31 along the flow channel.

The condensate water gathered in the bottom region 14 of the outdoor space region 31 is generally discharged to the outside by the condensate water discharge unit (not shown), etc. However, part of the condensate water can be scattered onto the condenser 32 by a scattering unit (not shown), etc. additionally installed or installed at the end of a wing of the cooling fan 33 in order to cool the condenser 32 more efficiently.

In the meantime, the conventional single unit type air conditioner can be installed in any space, but, it is generally installed at a window. However, because of the structure, there is a limit to adjust a width or a height of the air conditioner while securing a certain cooling performance.

In more detail, in the conventional single unit type air conditioner, because it is installed at a window, installation conditions may be intricate, in addition, it may injure the view.

TECHNICAL GIST OF THE PRESENT INVENTION

In order to solve the above-mentioned problems, it is an object of the present invention to provide an air conditioner that is capable of having a structure adjustable a height freely.

In order to achieve the above-mentioned objects, it is another object of the present invention to provide an air conditioner that is capable of adjusting a height thereof freely and cooling a condenser more efficiently by using condensate water.

In order to achieve the above-mentioned objects, an air conditioner in accordance with the present invention includes a casing having an indoor space region and an outdoor space region; an indoor unit installed in the indoor space region, sucking air and cooling the sucked air through a first heat exchanger; an outdoor unit installed in the outdoor space region, sucking air and releasing heat to the outside through a second heat exchanger; and a turbo fan installed in the outdoor space region for generating air flow so as to make air flow in the outdoor unit.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the preferred embodiment of an air conditioner in accordance with present invention will be described with reference to accompanying drawings.

Figure 1:
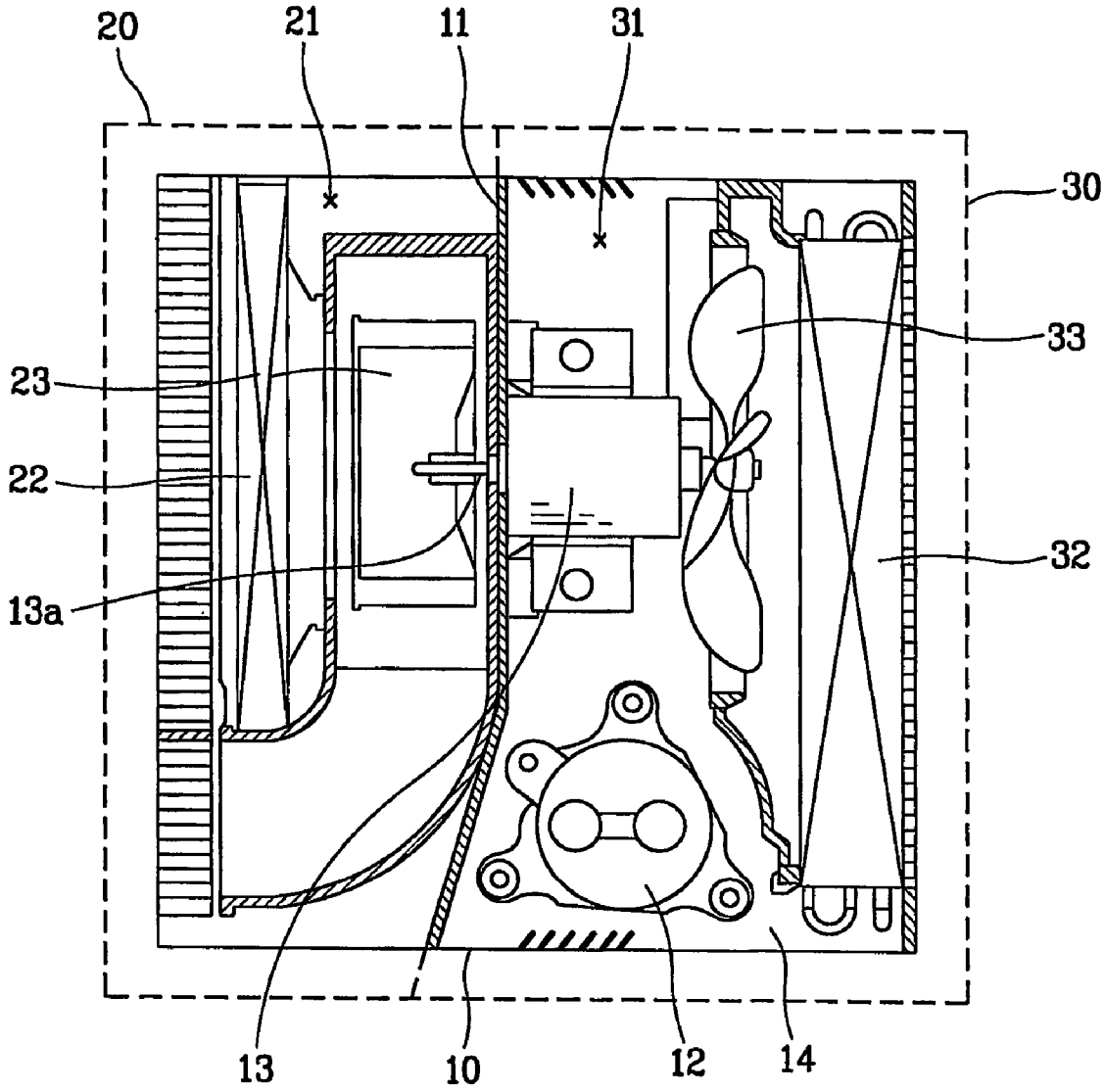
FIG. 1 is a longitudinal-sectional view illustrating the conventional single unit type air conditioner.
Figure 2:
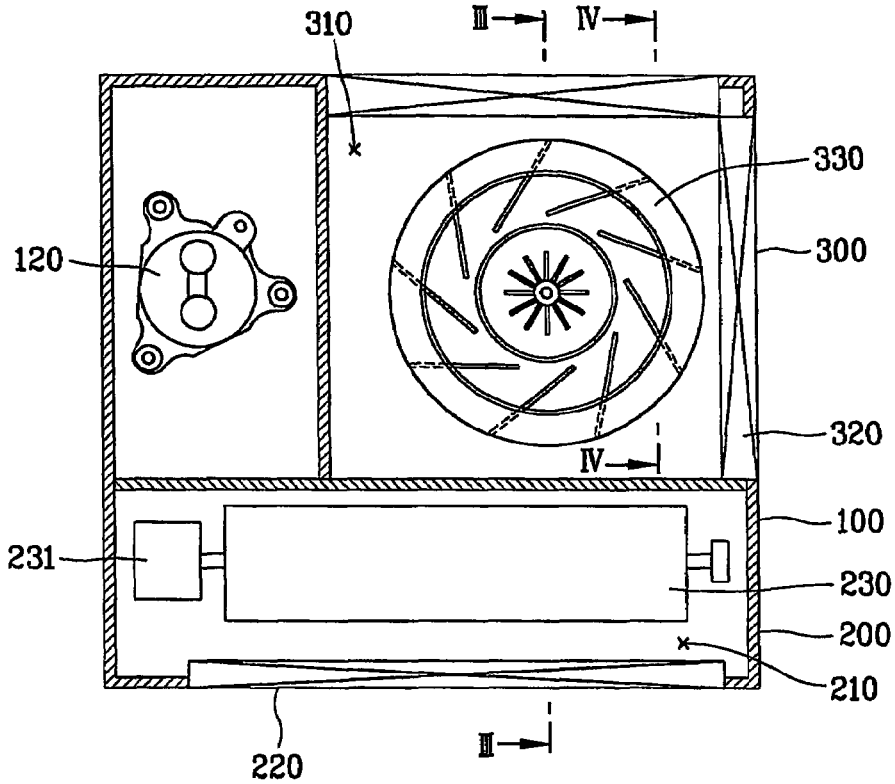
FIG. 2 is a sectional view illustrating an air conditioner in accordance with the present invention.
Figure 3:
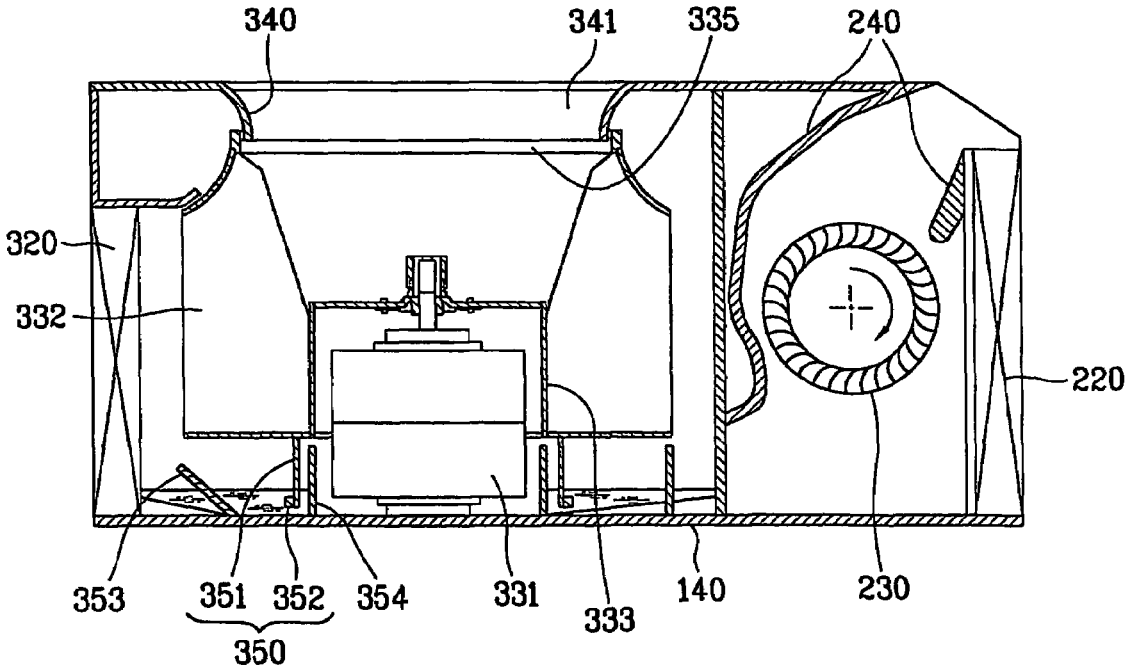
FIG. 3 is a sectional view illustrating a section of the air conditioner in FIG. 2 taken along a line III-III.

As depicted in FIGS. 2 and 3, the air conditioner in accordance with present invention includes a casing 100 having an indoor space region 210 and an outdoor space region 310; an indoor unit 200 installed in the indoor space region 210, sucking air and cooling the sucked air through a first heat exchanger 220; an outdoor unit 300 installed in the outdoor space region 310, sucking air and releasing heat to the outside through a second heat exchanger 320; and a turbo fan 330 installed in the outdoor space region 310 for making air flow to the second heat exchanger 320.

The indoor space region 210 and the outdoor space region 310 are separately formed by a separation plate 110 installed in the casing 100.

In the indoor space region 210, a cross flow fan 230 for sucking the indoor air and making it pass the first heat exchanger 220 and an indoor guide portion 240 for guiding the indoor air flow are formed. And, a fan of any other type can be used as an apparatus for generating air flow in the indoor space region 210 besides a cross flow fan.

And, a driving motor 231 for driving the cross flow fan 230 is installed at a certain side of the indoor space region 210 of the casing 100. By installing the cross flow fan 230 in the indoor space region 210, a height of the air conditioner can be lowered.

The first heat exchanger 220 is an evaporator constructing a refrigerating cycle of the air conditioner in accordance with the present invention, the first heat exchanger 220 is installed at the front of the casing 100 in the direction of the indoor space region 210, and cools the indoor air by performing heat exchange between refrigerant passing the first heat exchanger 220 with the sucked indoor air.

And, a compressor 120 for compressing the refrigerant passed from the first heat exchanger 220 is installed at a side of the casing 100.

In the outdoor space region 310, an outdoor air guide portion 340 for sucking the outdoor air from the upper portion of the outdoor space region 310 of the casing 100, passing the sucked outdoor air through the second heat exchanger 320 installed at the side of the outdoor space region 310 and discharging the air to the outside is formed.

The second heat exchanger 320 performs a function of a condenser constructing the refrigeration cycle of the air conditioner in accordance with the present invention. And the second heat exchanger 320 is installed at the side wall of the outdoor space region 310 and, when the outdoor air passes the second heat exchanger 320, heat of the refrigerant is released to the outside.

Figure 4:
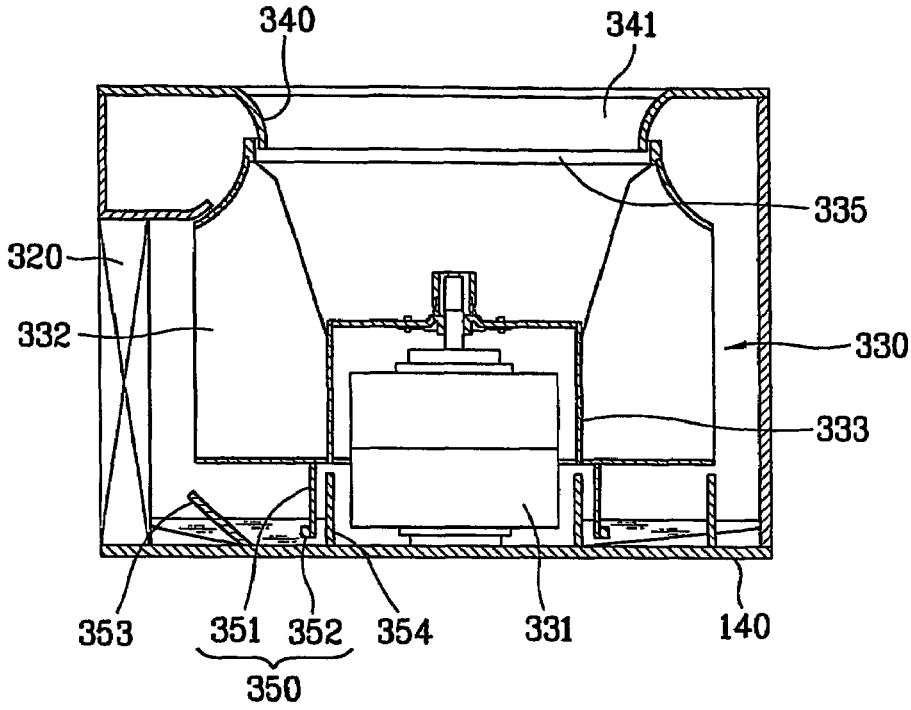
FIG. 4 is a sectional view illustrating a section of the air conditioner in FIG. 2 taken along a line IV-IV.
Figure 5:
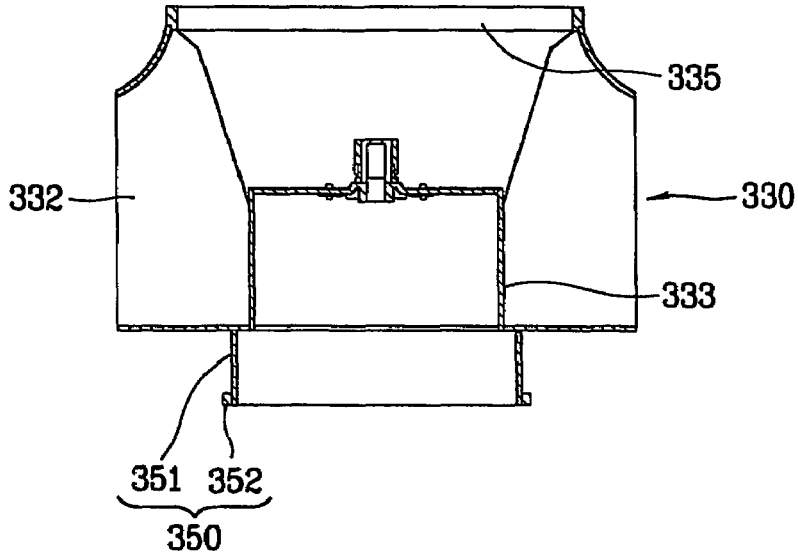
FIG. 5 is a sectional view illustrating a section structure of a turbo fan of the air conditioner in FIG. 2.

As depicted in FIGS. 4 and 5, the turbo fan 330 is installed on the outdoor air guide portion 340 perpendicular to a bottom region 140 of the casing 100 in the outdoor space region 310, and at the same time forms a part of the outdoor air guide portion 340.

In more detail, the turbo fan 330 includes a suction portion 335 connected to an outdoor air suction portion 341 formed at the upper portion of the outdoor space region 310; a discharge hole 332 formed toward the second heat exchanger 320; and a hub 333 connected to a rotational shaft of a driving motor 331 operated by the driving motor 331 fixedly installed at the bottom region 140 of the casing 100.

And, a scattering unit 350 is installed at the lower portion of the hub 333 of the turbo fan 330 in order to scatter condensate water gathered in the bottom region 140 to the second heat exchanger 320.

The scattering unit 350 includes an extended portion 351 extended from the lower portion of the hub 333 toward the bottom region 140; and a scattering protrusion portion 352 projected from the outer circumference of the extended portion 351.

The scattering protrusion portion 352 can be embodied in several forms without departing from the spirit or essential characteristics thereof, a plurality of scattering protrusion portions can be formed on the outer circumference of the extended portion, or a ring-shaped scattering protrusion portion can be formed.

A scattering guide portion 353 is formed at the bottom region 140 in the outdoor space region 310 in order to make condensate water gathered around the extended portion 351 of the scattering unit 350 be scattered to the second heat exchanger 320 more efficiently.

The scattering guide portion 353 is formed at the outer circumference of the scattering unit 350 at which the second heat exchanger 320 is installed so as to be inclined from the bottom region 140, and the scattering guide portion 353 has an arc shape.

In the meantime, a motor protecting member 354 is extended-installed at the bottom region 140 in order to protect the driving motor 331 from the condensate water scattered by the scattering unit 350 or prevent the condensate water from flowing towards the driving motor 331.

In addition, a condensate water flow path 141 is formed at the bottom region 140 in order to make the condensate water flow from the indoor space region 20 to the outdoor space region 310. In order to improve a scattering efficiency, a plurality of inclined portions 142 are formed at the bottom region 140 in the outdoor space region 310 so as to make more condensate water gather in a portion corresponded to the scattering unit 350.

Figure 6:
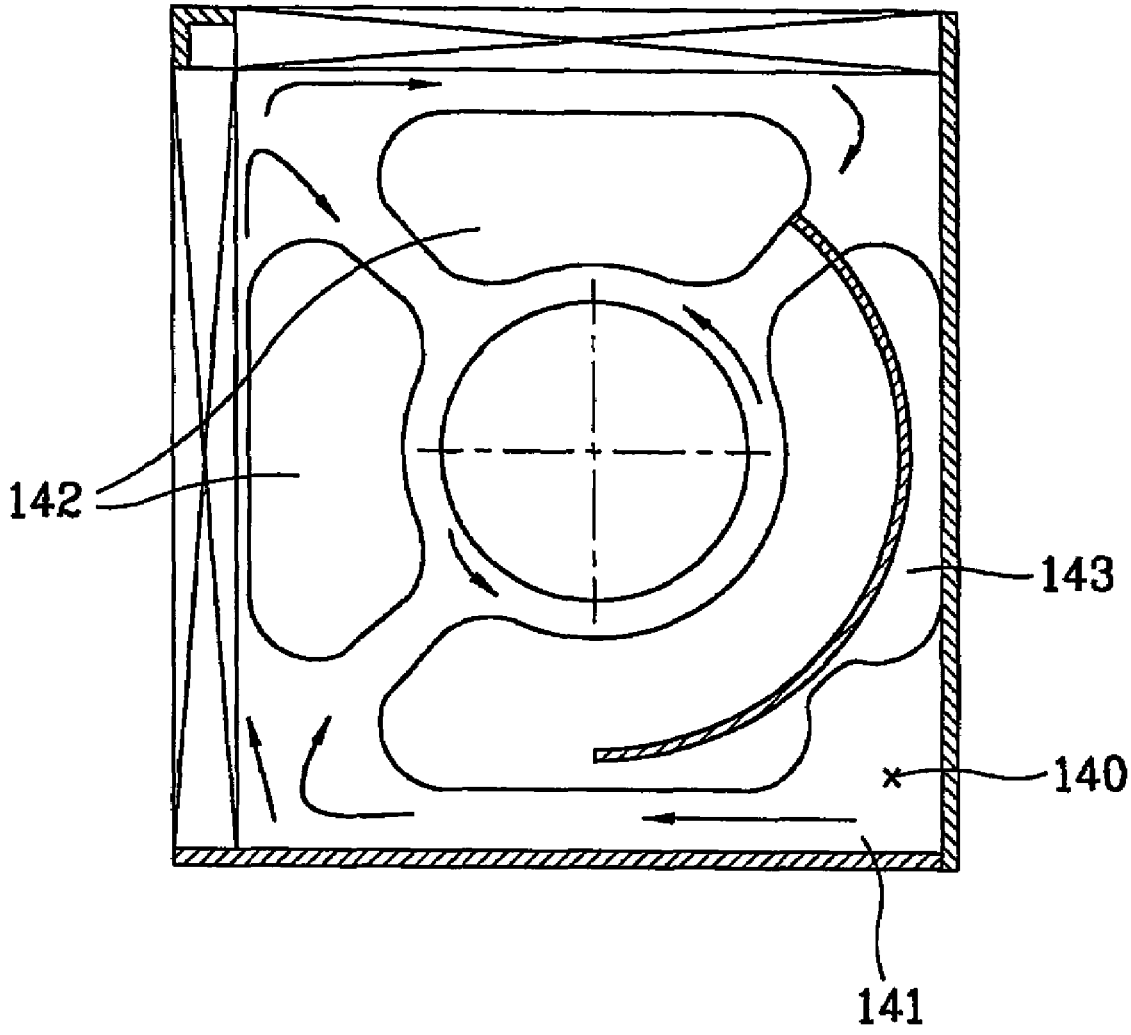
FIG. 6 is a conceptual view illustrating a structure of a bottom region of the air conditioner in FIG. 2.

In the above-described structure, the more condensate water stays in the scattering unit 350 by the bottom region 140, and the larger amount of condensate water is scattered to the second heat exchanger 320. Arrows in FIG. 6 show flows of the condensate water.

The large amount of condensate water is scattered to the outdoor space region 310 by the scattering unit 350, herein, a scattering preventive unit 143 for protecting the indoor space region 210 from the scattered condensate water can be installed.

The operation of the air conditioner in accordance with the present invention will be described in more detail. Herein, general operations will be abridged for convenience.

In the operation of the air conditioner in accordance with the present invention, condensate water is formed in the first heat exchanger 2, the condensate water flows along the condensate water flow channel 141 and stays in the bottom region 140 of the outdoor space region 310.

The turbo fan 330 sucks the outdoor air while being rotated by the driving motor 331 and makes it pass the second heat exchanger 320 continuously. In that process, the scattering unit 350 installed at the hub 333 of the turbo fan 330 scatters the stayed condensate water.

In more detail, when the condensate water is scattered by the scattering protrusion portion 352 of the scattering unit 350, the condensate water can be evenly scattered to the second heat exchanger 320 by the scattering guide portion 353 with the air flow formed by the turbo fan 330.

The condensate water scattered on the surface of the second heat exchanger 320 is evaporated with the flow of the outdoor air, in that process, the second heat exchanger 320 is cooled, and accordingly heat of the refrigerant flowing in the second heat exchanger 320 is released to the outside.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

In particular, it is also possible to use a structure of an outdoor unit in accordance with the present invention for an air conditioner having an indoor unit and an outdoor unit separately.

INDUSTRIAL APPLICABILITY

In an air conditioner in accordance with the present invention, by arranging a turbo fan installed so as to be perpendicular to a bottom region of a casing in an outdoor unit, it is possible to reduce noise in operation of the air conditioner and adjust a height of the outdoor unit freely, and accordingly it is possible to improve the view of a single unit type air conditioner which is installed at a window.

In addition, in an air conditioner in accordance with the present invention, by using a turbo fan for an outdoor unit and installing a scattering unit for scattering condensate water to a condenser/outdoor heat exchanger, the condenser can be cooled more efficiently, and accordingly it is possible to improve an efficiency of the air conditioner.

The invention claimed is:

1. An air conditioner, comprising:

a casing having an indoor space region and an outdoor space region;

an indoor unit installed in the indoor space region, sucking air and cooling the sucked air through a first heat exchanger;

an outdoor unit installed in the outdoor space region, sucking air and releasing heat of the air to the outside through a second heat exchanger; and a turbo fan installed in the outdoor space region for generating air flows so as to flow air to the second heat exchanger, wherein the casing includes a bottom region formed so as to make condensate water formed in the first heat exchanger flow to the outdoor space region, the turbo fan is installed perpendicular to a bottom region, and a hub having a scattering unit for scattering condensate water gathered in the bottom region to the second heat exchanger is further included.

2. The air conditioner of claim 1, wherein the scattering unit includes:

an extended portion extended from the lower portion of the hub toward the bottom region; and a scattering protrusion portion projected from the outer circumference of the extended portion.

3. The air conditioner of claim 2, wherein there are a plurality of scattering protrusion portions.

4. The air conditioner of claim 2, wherein a scattering guide portion is formed around the extended portion of the scattering unit in the bottom region in order to make the condensate water be scattered to the second heat exchanger more efficiently.

5. The air conditioner of claim 1, wherein a motor protecting member is extended-formed in the bottom region in order to protect a motor for driving the turbo fan from the scattered condensate water.

6. The air conditioner of claim 2, wherein a plurality of inclined portions are formed so as to be corresponded to the extended portion of the scattering unit in the bottom region in order to make the condensate water gather in the scattering unit installation portion.

7. The air conditioner of claim 1, wherein a scattering preventive portion is installed at part of the exterior of the scattering unit in order to prevent the condensate water from being scattered to the indoor space region.

8. The air conditioner of claim 1, wherein a cross flow fan is installed in the indoor space region.

* * * * *